US010858957B2

(12) United States Patent
Perez et al.

(10) Patent No.: US 10,858,957 B2
(45) Date of Patent: Dec. 8, 2020

(54) TURBOMACHINE BLADE, COMPRISING A ROOT WITH REDUCED STRESS CONCENTRATIONS

(71) Applicant: SAFRAN AIRCRAFT ENGINES, Paris (FR)

(72) Inventors: Guillaume Perez, Combs la Ville (FR); Laurent Donatien Behaghel, Neuville sur Saone (FR); Guillaume Brun, Chilly-Mazarin (FR); Matthieu Loger, Orly (FR); Arnaud Sanchez, Quincy-sous-Senart (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 464 days.

(21) Appl. No.: 15/435,781

(22) Filed: Feb. 17, 2017

(65) Prior Publication Data

US 2017/0241292 A1 Aug. 24, 2017

(30) Foreign Application Priority Data

Feb. 19, 2016 (FR) ..... 16 51386

(51) Int. Cl.
*F01D 25/24* (2006.01)
*F01D 9/04* (2006.01)
(Continued)

(52) U.S. Cl.
CPC ..... *F01D 25/243* (2013.01); *F01D 9/041* (2013.01); *F01D 25/162* (2013.01); *F01D 25/246* (2013.01); *F01D 5/141* (2013.01); *F05D 2220/32* (2013.01); *F05D 2220/36* (2013.01); *F05D 2240/122* (2013.01); *F05D 2240/80* (2013.01); *F05D 2260/31* (2013.01); *F05D 2260/94* (2013.01)

(58) Field of Classification Search
CPC .... F01D 25/243; F01D 25/245; F01D 25/246; F05D 2240/80; F05D 2260/31
USPC ..... 415/209.2; 416/193 A
See application file for complete search history.

(56) References Cited

U.S. PATENT DOCUMENTS 4,171,930 A * 10/1979 Brisken ..... F01D 5/3015 416/193 A
4,480,958 A * 11/1984 Schlechtweg ..... F01D 11/006 416/219 R
(Continued)

FOREIGN PATENT DOCUMENTS

CA 2749476 A1 * 2/2012 ..... F01D 9/042
DE 10 2004 004 014 A1 8/2005
(Continued)

OTHER PUBLICATIONS

French Preliminary Search Report dated Nov. 7, 2016 in French Application 16 51386 filed on Feb. 19, 2016 (with English Translation of Categories of Cited Documents).

*Primary Examiner* — David E Sosnowski
*Assistant Examiner* — Hakeem M Abdellaoui
(74) *Attorney, Agent, or Firm* — Oblon, McClelland, Maier & Neustadt, L.L.P.

(57) ABSTRACT

A flange of a blade root platform is separated from an adjacent edge of the blade by a groove that prevents direct transmission of forces created by the bolted attachment of the platform flange to the adjacent part of the blade and reduces stress concentrations.

9 Claims, 3 Drawing Sheets

(51) Int. Cl.
*F01D 25/16* (2006.01)
*F01D 5/14* (2006.01)

(56) References Cited

U.S. PATENT DOCUMENTS 5,669,759 A 9/1997 Beabout
5,988,980 A * 11/1999 Busbey ..... F01D 5/143 415/78
6,761,536 B1 7/2004 Bash et al.
6,951,447 B2 * 10/2005 Cherolis ..... F01D 5/141 416/193 A
7,238,008 B2 * 7/2007 Bobo ..... F01D 5/3015 416/220 R
7,632,071 B2 * 12/2009 Charbonneau ..... F01D 5/081 416/193 A
8,142,143 B2 * 3/2012 Kreiselmaier ..... F01D 11/005 415/191
8,147,190 B2 * 4/2012 Tsypkaykin ..... F01D 9/042 415/191
8,287,241 B2 * 10/2012 Strohl ..... F01D 5/141 416/190
10,125,630 B2 * 11/2018 Bois ..... F01D 5/025
2003/0068225 A1 * 4/2003 Housley ..... F01D 9/04 415/189
2010/0129228 A1 5/2010 Strohl et al.
2011/0070089 A1 3/2011 Kreiselmaier et al.

FOREIGN PATENT DOCUMENTS

EP 0 844 369 A1 5/1998
EP 1 219 778 A2 7/2002
EP 1 544 410 A1 6/2005
EP 1 811 131 A2 7/2007
GB 646728 A 11/1950
WO WO 2009/115384 A1 9/2009
WO WO 2009/115390 A1 9/2009

* cited by examiner

TURBOMACHINE BLADE, COMPRISING A ROOT WITH REDUCED STRESS CONCENTRATIONS

BACKGROUND OF THE INVENTION

Field of the Invention

The subject of the invention is a turbomachine blade comprising a root with reduced stress concentrations.

Description of the Related Art

Some turbomachine blades, one example of which is represented in FIG. 1, include the following arrangement. It is a fixed flow guide vane in an outer flow stream 2 of a twin-spool turbomachine 2 downstream from a fan 3, but other categories of vanes, or by extension other turbomachine arms (particularly radial), could be fitted with the invention.

The blade 1 comprises an airfoil 4 passing through the outer flow stream 2, a head end 5 bolted to an outer casing 6 and the other end, a root 7 connected to an inner casing 8 separating the outer flow stream 2 from the inner flow stream 9. The root 7 comprises a platform 10 for which the main extension direction is parallel or almost parallel to the X-X axial direction of the turbomachine, extends over a section of a circle, and it also comprises a flange 11 at one end 34 (in this case a downstream end) of the platform 10 along the X-X direction, that is fixed to the inner case 8 by bolts 12 (the invention would still be applicable if the flange were fitted to the outer case 6). The blade 1 is a single piece, the airfoil 4 being directly connected to the platform 10. FIG. 2 is an enlargement of a zone located behind the blade 1 containing a better view of the flange 11 and the parts adjacent to it, namely one end of the platform 10 and a portion of the airfoil 4, limited by the trailing edge of the airfoil. This region of the blade 1 is subjected to high stress concentrations that can compromise its fatigue strength. These stress concentrations appear especially in a zone 15 of the blade 4, adjacent to the connection 16 of the leading edge 13 with the platform 10, with a single piece structure of the blade 1. Another significant stress concentration zone is observed at the free end 17 of the flange 11, furthest from the platform 10 along the Y-Y radial direction of the turbomachine.

The purpose of the invention is to attenuate these stress concentrations. This is achieved by means of a turbomachine blade comprising an airfoil and a root, the root including a platform and a flange through which bolt holes are formed for bolting to a case of the turbomachine, the airfoil and the flange forming a single piece with the platform and extending along opposite directions from the platform along a radial direction (Y-Y) of the turbomachine, the airfoil comprising an edge connected to the platform, the platform extending from one end along an essentially axial direction (X-X) of the turbomachine, characterised in that the root comprises a groove extending from said end, between the platform and the flange and penetrating in said essentially axial direction towards a bottom beyond a connection point of said edge of the airfoil and the platform and beyond the entire flange; said connection point of the edge of the airfoil and the platform is located along said essentially axial direction (X-X), between said end of the platform and at least one face of the flange facing said end; the flange being connected to the platform by a neck delimited by a face of the groove and extending mainly along said essentially axial direction (X-X) from the flange to the heel, and having a thickness less than the minimum thickness of the flange.

Note that several documents (EP 1 811 131 A2, DE 10 2004004014 A1, U.S. Pat. No. 5,669,759 A, WO 2008 115390 A1 and WO 2009 115384 A1) disclose blade roots notched at one end, in front of an edge of the airfoil, to reduce stress concentrations; but these devices either do not have a bolting flange, or the connection of the edge to the root is not brought closer to the end than the flange, or the groove does not extend beyond the flange, or the flange is not connected to the root by a thinned neck.

The invention is based on the observation that stress concentrations are explained especially by direct transmission of forces produced by the attachment of blade 1 and that appear in the flange 11. The essential purpose of the groove is to eliminate the direct communication between the zone 15 of the airfoil 4 adjacent to both the edge 13 and to the root 7, and the flange 11. The zone 15, then being close to a much more flexible portion of the blade 1, is relieved; forces that were responsible for the stress concentration are transmitted to other parts of the blade 1, without causing the development of any important stress concentrations.

All the characteristics described above contribute more specifically to making a more sinuous stress path between the end of the airfoil, its connection to the root platform, and bolted attachments of the flange to give better resistance (in this precise configuration with two highly loaded zones 15 and 17) to direct transmission of forces between highly stressed regions of the flange and the connection between the airfoil and the root, and thus reduce stress concentrations; and the flexibility of the neck is such that the flange can deflect more easily and further reduce stress concentrations due to the flexibility obtained.

Some improvements to this basic design can reinforce the flexibility of the arrangement and further reduce stress concentrations to critical zones; this is the case particularly if the platform comprises a heel, corresponding to a thickening of the platform in the radial direction, extending beyond the bottom of the groove along the essentially axial direction, the neck connecting the heel to the flange.

Note that the invention is perfectly applicable to arrangements in which the flange comprises a thinned central portion between two concentric conical portions, the central portion being drilled with bolt holes, the conical bearing surfaces facing the end of the platform.

According to other improvements, also reducing local stress concentrations in this case: the flange is connected to the heel by a rounded surface; or the groove opens up towards said end of the platform and is delimited by two faces converging towards the bottom, and the bottom is formed by a rounded surface joining said faces.

The airfoil edge concerned may be the trailing edge, for example as in FIGS. 1 and 2, or the leading edge of the airfoil; however problems are usually more severe with the trailing edge, since the airfoil is thinner near this edge.

BRIEF DESCRIPTION OF THE SEVERAL VIEWS OF THE DRAWINGS

We will now give a complete description of a particular embodiment of the invention, that will be sufficient to clearly understand its different aspects, characteristics and advantages with reference to the following figures.

DETAILED DESCRIPTION OF THE INVENTION

Figure 1:
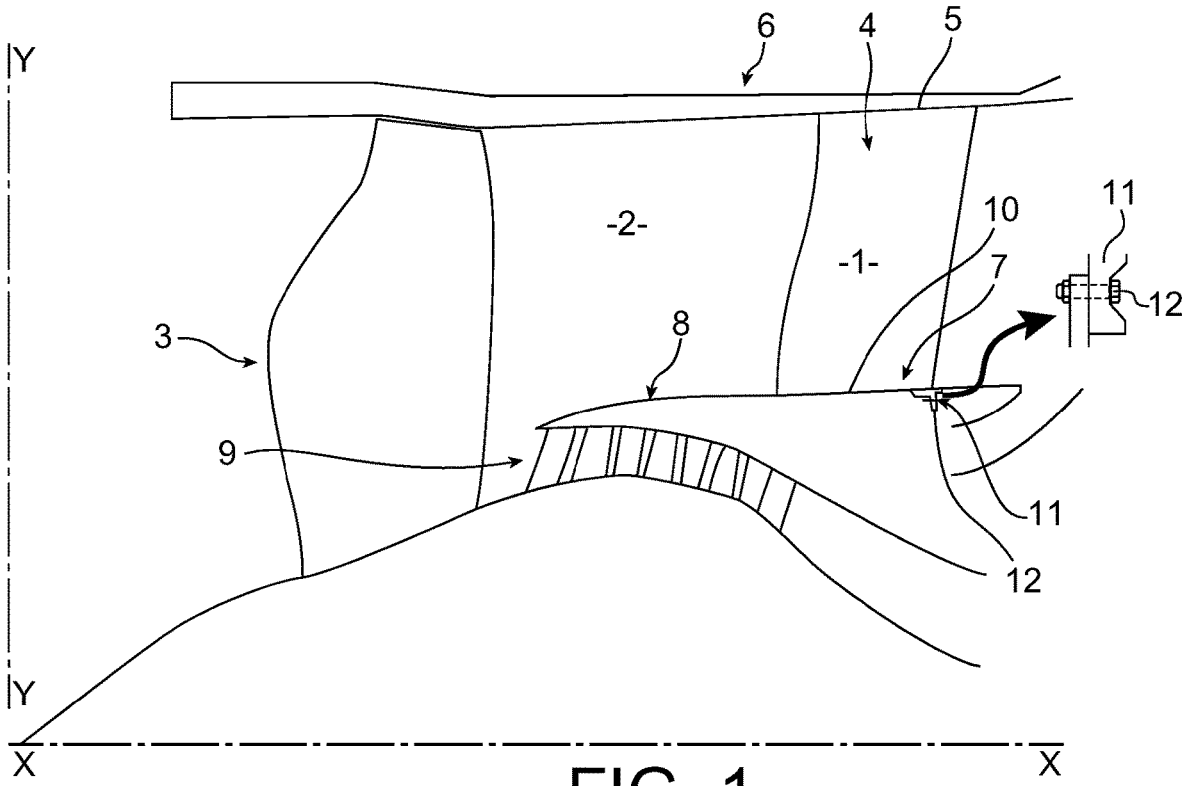
FIG. 1 Prior Art
FIG. 1, already described, represents a blade according to prior art.
Figure 2:
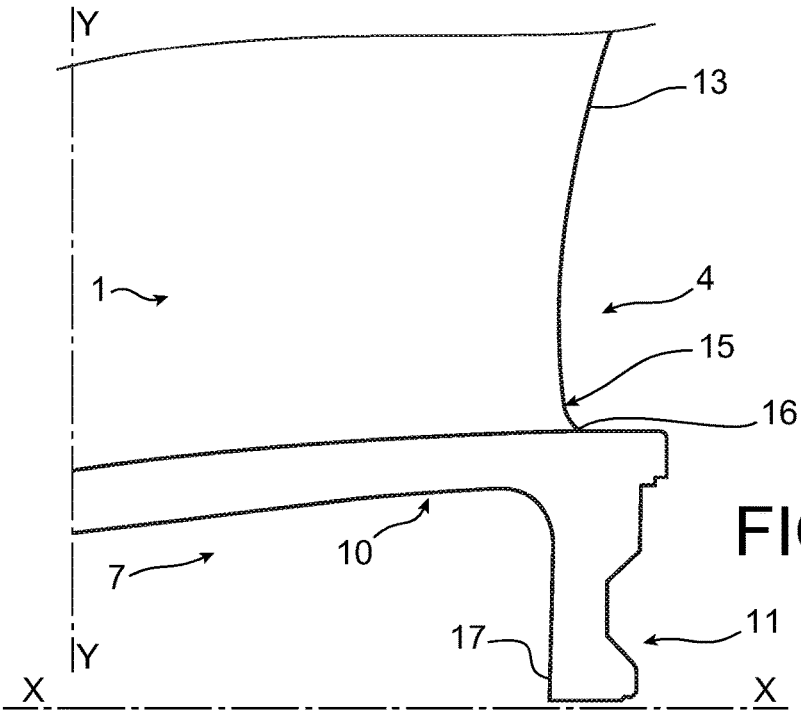
FIG. 2 Prior Art
FIG. 2 is an enlargement of FIG. 1 showing an end region of the blade platform.
Figure 3:
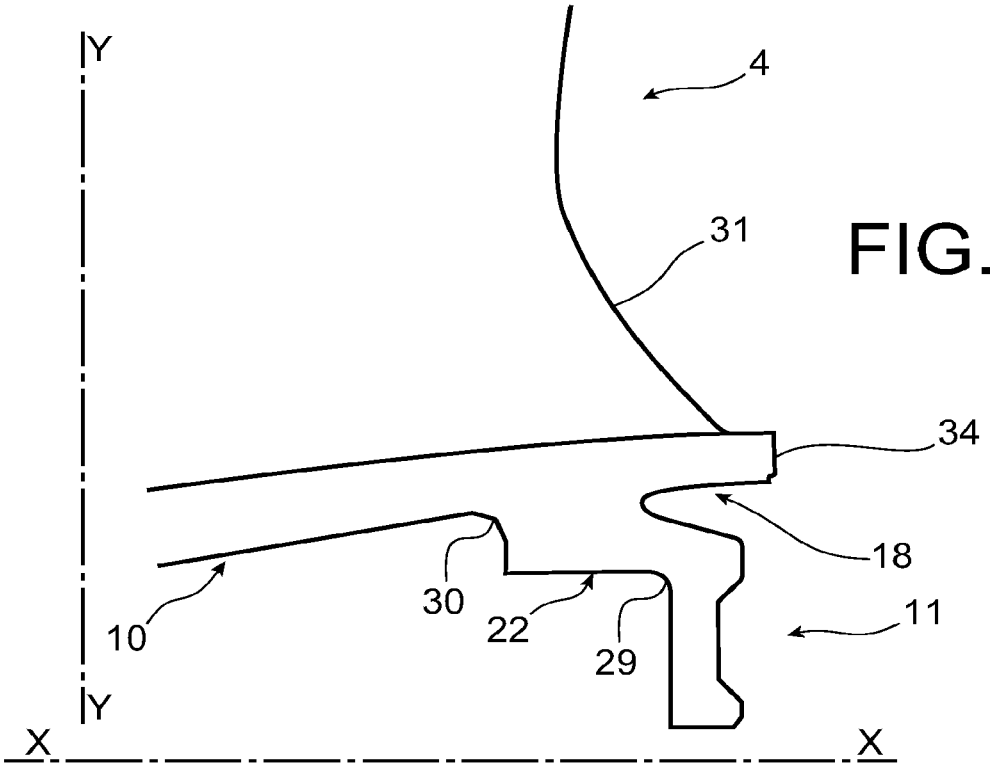
FIG. 3 represents the same region for a blade characteristic of the invention.
Figure 4:
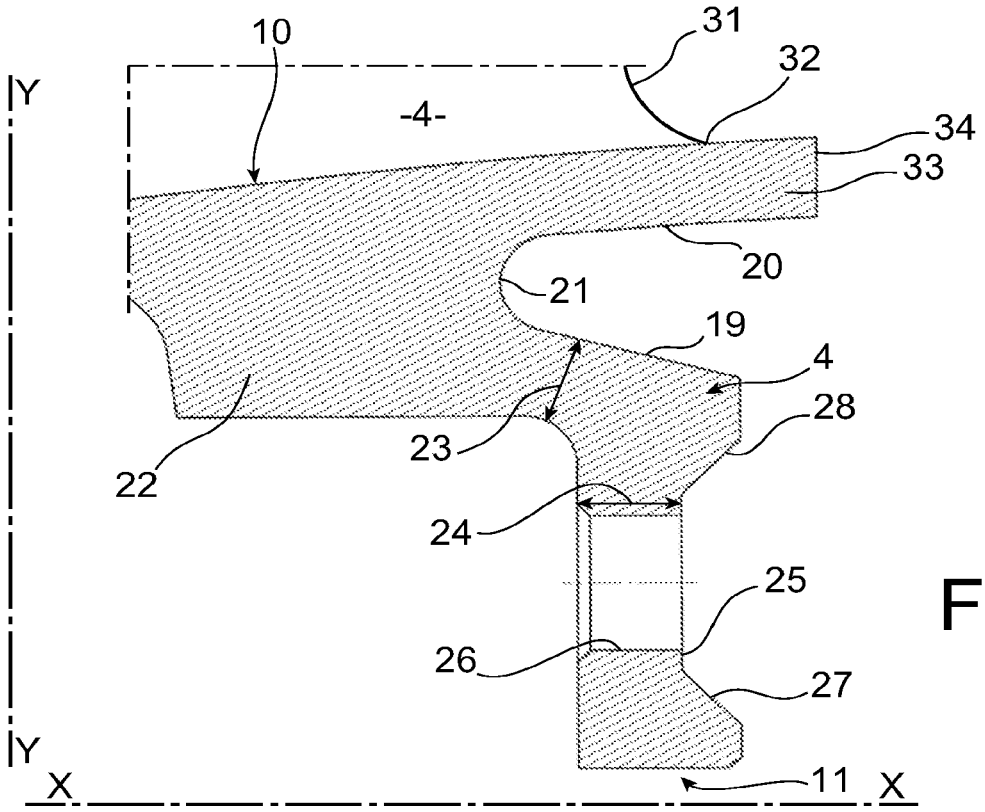
FIG. 4 is an enlargement of FIG. 3.

Refer to FIGS. 3 and 4. Unlike the design shown on FIG. 2, the flange 11 is now separated from the platform 10 by a groove 18. This groove 18 is delimited by a conical face 19 on one side of the flange 11, and another face 20 that is conical or cylindrical as in this case, on the side of the platform 10, the faces 19 and 20 converging towards each other and connecting to each other at a rounded groove bottom 21. The groove 18 is fairly deep, from its opening to the bottom 21, to extend over the entire thickness of the flange 11 and beyond it, and thus to separate it from the airfoil 4 in a radial direction Y-Y of the turbomachine. The bottom 21 extends projecting in the axial direction X-X and in the upstream direction (along the direction of flow of fluid around the blade 1) beyond the connection point 32 of the edge 31 of the airfoil 4 to the platform 10. Upstream from the bottom 21 of the groove 18 in the axial direction X-X, the platform 10 is thickened in the radial direction Y-Y, by a heel 22 that is connected to the flange 11 by a neck 23. The neck 23, delimited by face 19, is less thick than the minimum thickness 24 of the flange 11 (in this case a thinned central portion 25 in which the bolt holes 26 are formed, and limited by two concentric conical bearing surfaces 27 and 28, as is usual for this type of flange). Other rounded parts 29 and 30 are formed on concave fillets between the flange 11 and the heel 22, and between the heel 22 and the platform 10 itself.

Note that unlike usual designs, the edge 31 of the airfoil 4 on the side of the flange 11 is moved towards the end 34 of the platform 10, such that its connection point 32 with the platform 10 extends beyond at least one of the faces of the flange 11 (in this case the face of the thinned central portion 25) that face towards said end 34 along the axial direction X-X.

The flange 11 is mounted flexibly on the platform 10 by the thin neck 23. The corner of the airfoil 4 adjacent to the connection point 32 is also mounted flexibly on the platform 10, the end of which above the groove 18 forms a projection 33 that is also thin on which this corner and therefore the connection point 32 extends. The increased flexibility of the blade 1 at these locations can reduce stress concentrations, by distributing forces towards adjacent areas with lower loads. Therefore it is advantageous if the groove 18 is relatively wide between the faces 19 and 20 to accentuate the flexibility at immediately adjacent locations of the blade 1 (the neck 23 and the projection 33). It is also advantageous if the groove 18 is sufficiently deep to the bottom 21 so that the neck 23 and the projection 33 can be extended with the same effect of increased flexibility, and to make the transmission path of forces between the flange 11 and the corner of the airfoil 4 more sinuous, and thus reduce their magnitude. The heel 22 helps in distributing stresses and therefore reducing their concentration at the end 34 of the airfoil 1; the rounded parts 29 and 30, and the rounded bottom 21, also tend to reduce local stress concentrations.

Figure 5:
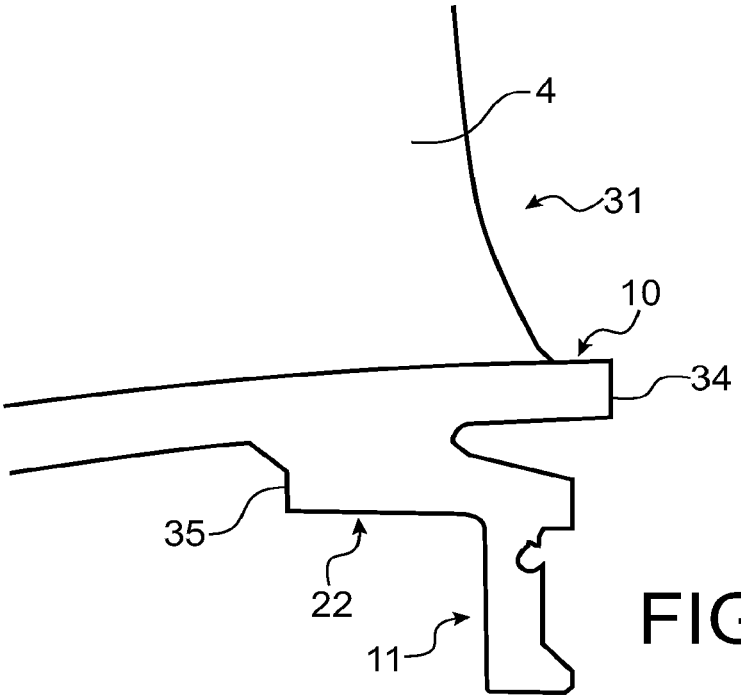
FIGS. 5 and 6 represent two design variants of the blade.
Figure 6:
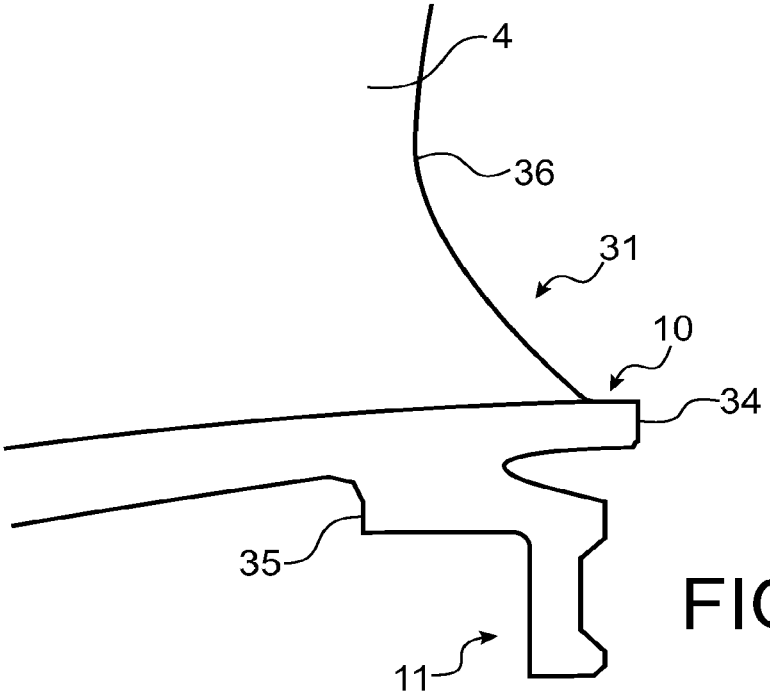

If the edge 31 of the airfoil 4 is pushed towards the end 34 of the platform 10, its profile from the platform 10 is not critical concerning the reduction of stress concentrations: the layouts in FIGS. 5 and 6 have both given good results in this respect.

Unlike the profile of the trailing edge 13 in FIG. 2 that; starting from the platform 10 and working in a radially outwards direction, bends firstly briefly forwards and then backwards, the profile in FIG. 5 according to the invention bends towards the upstream direction by a height greater than or equal to the distance between the end 34 and an upstream face 35 of the heel 22, with a steep slope in the upstream direction (about 30°) close to the platform 10, and then progressively decreasing; and the profile in FIG. 6, also according to the invention, bends in the upstream direction with a steep (more than 30°) and approximately constant slope over a height equal to approximately the distance between the end 34 and the upstream face 35; and then radially further outwards, it bends slightly in the downstream direction with a shallow slope (about 10°), with a marked inflection point 36 from the previous slope.

The invention claimed is:

1. A turbomachine blade comprising:

an airfoil; and a root, the root including a platform, the airfoil comprising an edge connected to the platform, the platform extending from an end of the platform along an axial direction of the turbomachine, wherein the root comprises a groove extending from said end of the platform and penetrating in said essentially axial direction up to a bottom beyond a connection point of said edge of the airfoil and the platform, wherein the root includes a flange through which bolt holes are formed for bolting to a case of the turbomachine, the airfoil and the flange forming a single piece with the platform and extending along an opposite direction from the platform along a radial direction of the turbomachine, the groove extending between the platform and the flange, and the flange is connected to the platform by a neck delimited by a face of the groove and extending mainly along said axial direction from the flange to the platform, wherein the groove penetrates in the root beyond the entire flange, wherein said connection point of the edge of the airfoil and the platform is located along said axial direction between said end of the platform and at least one face of the flange facing said end of the platform, and wherein the neck has a thickness less than a minimum thickness of the flange.

2. The blade according to claim 1, wherein the platform comprises a heel corresponding to a thickening of the platform in the radial direction, extending beyond the bottom of the groove along the axial direction, the neck connecting the heel to the flange.

3. The blade according to claim 2, wherein the flange is connected to the heel through a rounded surface.

4. The blade according to claim 1, wherein the groove opens up towards said end of the platform and is delimited by two faces converging towards the bottom, and the bottom is formed by a rounded surface joining said faces.

5. The blade according to claim 4, wherein said faces comprise a cylindrical face delimiting the platform and a conical face delimiting the flange.

6. The blade according to claim 1, wherein the flange comprises a thinned central portion between two concentric conical bearing surfaces, the central portion being drilled with bolt holes, the conical bearing surfaces facing said end of the platform.

7. The blade according to claim 1, wherein said edge is a trailing edge of the blade.

8. The blade according to claim 1, wherein the blade is a fixed blade of the turbomachine which is present in an outer flow stream of the turbomachine, which is a twin-spool turbomachine.

9. A turbomachine blade, comprising:

a airfoil; and a root, the root including a platform, the airfoil comprising a trailing edge connected to the platform, the platform extending from an end of the platform along an axial direction of the turbomachine, the root comprising a groove extending from said end of the platform and penetrating in said axial direction up to a bottom beyond a connection point of said trailing edge of the airfoil and the platform, wherein the root includes a flange, through which bolt holes are formed for bolting to a case of the turbomachine, the airfoil and the flange forming a single piece with the platform and extending along an opposite direction from the platform along a radial direction of the turbomachine, the groove extended between the platform and the flange, and the flange is connected to the platform by a neck delimited by a face of the groove and extending mainly along said axial direction from the flange to the platform, wherein the groove penetrates in the root beyond the entire flange, wherein said connection point of the trailing edge of the airfoil and the platform is located along said axial direction between said end of the platform and least one face of the flange facing said end of the platform, wherein the neck has a thickness less than a minimum thickness of the flange, wherein the platform comprises a heel corresponding to a thickening of the platform in the radial direction, extending beyond the bottom of the groove along the axial direction, and the neck connects the flange to the heel of the platform through a rounded surface, and wherein the trailing edge of the airfoil has a slope of 30° in an upstream direction over a height equal or greater to a distance between said end of the platform and an upstream face of the heel.

* * * * *